US007587271B2

(12) United States Patent
Kiim

(10) Patent No.: US 7,587,271 B2
(45) Date of Patent: Sep. 8, 2009

(54) SYSTEM AND METHOD FOR PREVENTING TRAFFIC SIGNAL VIOLATION USING INFRARED COMMUNICATION

(75) Inventor: Sung Joong Kiim, Icheon-shi (KR)

(73) Assignee: Hyundai Autonet Co., Ltd., Icheon-Shi, Kyungki-Do (KR)

( * ) Notice: Subject to any disclaimer, the term of this patent is extended or adjusted under 35 U.S.C. 154(b) by 684 days.

(21) Appl. No.: 11/306,615

(22) Filed: Jan. 4, 2006

(65) Prior Publication Data

US 2006/0184312 A1 Aug. 17, 2006

(30) Foreign Application Priority Data

Feb. 3, 2005 (KR) ..... 10-2005-0009881

(51) Int. Cl.
*G08G 1/00* (2006.01)

(52) U.S. Cl. ..... 701/117; 340/905

(58) Field of Classification Search ..... 701/36, 701/70, 117, 119, 300, 301; 340/539.13, 340/539.1, 901, 904, 907, 933, 935
See application file for complete search history.

(56) References Cited

U.S. PATENT DOCUMENTS 6,405,132 B1 * 6/2002 Breed et al. ..... 701/301
6,707,391 B1 * 3/2004 Monroe ..... 340/901
7,110,880 B2 * 9/2006 Breed et al. ..... 701/207
7,383,121 B2 * 6/2008 Shinada ..... 701/117
7,466,727 B2 * 12/2008 Galun et al. ..... 372/10
2003/0016143 A1 * 1/2003 Ghazarian ..... 340/901

FOREIGN PATENT DOCUMENTS

| | | |
|---|---|---|
| JP | 2263286 | 10/1990 |
| JP | 11161894 | 6/1999 |
| JP | 2000306190 | 11/2000 |
| JP | 2002298286 | 10/2002 |
| KR | 100166511 | 9/1998 |

* cited by examiner

*Primary Examiner*—Richard M. Camby
(74) *Attorney, Agent, or Firm*—IPLA P.A.; James E. Bame

(57) ABSTRACT

A system and method for preventing traffic signal violation using infrared communication is provided. The system includes a traffic light controlling system for, when a traffic light changes, transmitting traffic information; a brake system for decelerating or stopping a vehicle under a predetermined control; and a traffic signal violation prevention device installed at the vehicle, and receiving the traffic information and, if the traffic information is stop signal information, transmitting a stop signal to the brake system.

7 Claims, 4 Drawing Sheets

SYSTEM AND METHOD FOR PREVENTING TRAFFIC SIGNAL VIOLATION USING INFRARED COMMUNICATION

BACKGROUND OF THE INVENTION

1. Field of the Invention

The present invention relates to a system for preventing traffic signal violation, and more particularly, to a system and method for preventing driver's traffic signal violation using infrared communication.

2. Description of the Related Art

As a conventional method for preventing driver's traffic signal violation, there is a first method where a driver voluntarily observes a traffic signal based on his/her morality, and a second method where a monitoring camera is installed at a traffic light to impose a penalty on a driver violating the traffic signal, thereby inducing the driver to observe the traffic signal.

However, the first method has a drawback in that the driver lack of the morality, or the driver having the morality but not recognizing change of the traffic light violates the traffic signal.

The second method has drawback in that it costs a lot of money in installing the monitoring camera at many crossroads, such as a purchase cost, an installation cost, and a management cost of the monitoring camera.

SUMMARY OF THE INVENTION

Accordingly, the present invention is directed to a system and method for preventing traffic signal violation using infrared communication that substantially overcome one or more of the limitations and disadvantages of the conventional art.

One object of the present invention is to provide a system and method for preventing driver's traffic signal violation using infrared communication.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims as well as the appended drawings.

To achieve the above and other objects and advantages, and in accordance with the purpose of the invention, as embodied and broadly described herein, there is provided a system for preventing traffic signal violation using infrared communication, the system including: a traffic light controlling system for, when a traffic light changes, transmitting traffic information; a brake system for decelerating or stopping a vehicle under a predetermined control; and a traffic signal violation prevention device installed at the vehicle, and receiving the traffic information and, if the traffic information is stop signal information, transmitting a stop signal to the brake system.

In another aspect of the present invention, there is provided a method for preventing traffic signal violation using infrared communication, the method including the steps of: when a traffic light changes, transmitting traffic information in a traffic light controlling system; in a traffic signal violation prevention device, receiving the traffic information and, when the traffic information is stop signal information, generating and transmitting a stop signal; and in a brake system, receiving the stop signal to decelerate or stop a vehicle.

It is to be understood that both the foregoing summary and the following detailed description of the present invention are merely exemplary and intended for explanatory purposes only.

BRIEF DESCRIPTION OF THE DRAWINGS

The accompanying drawings, which are included to aid in understanding the invention and are incorporated into and constitute a part of this application, illustrate embodiment(s) of the invention and together with the description serve to explain the principles of the invention. In the drawings.

DETAILED DESCRIPTION OF THE INVENTION

Figure 1:
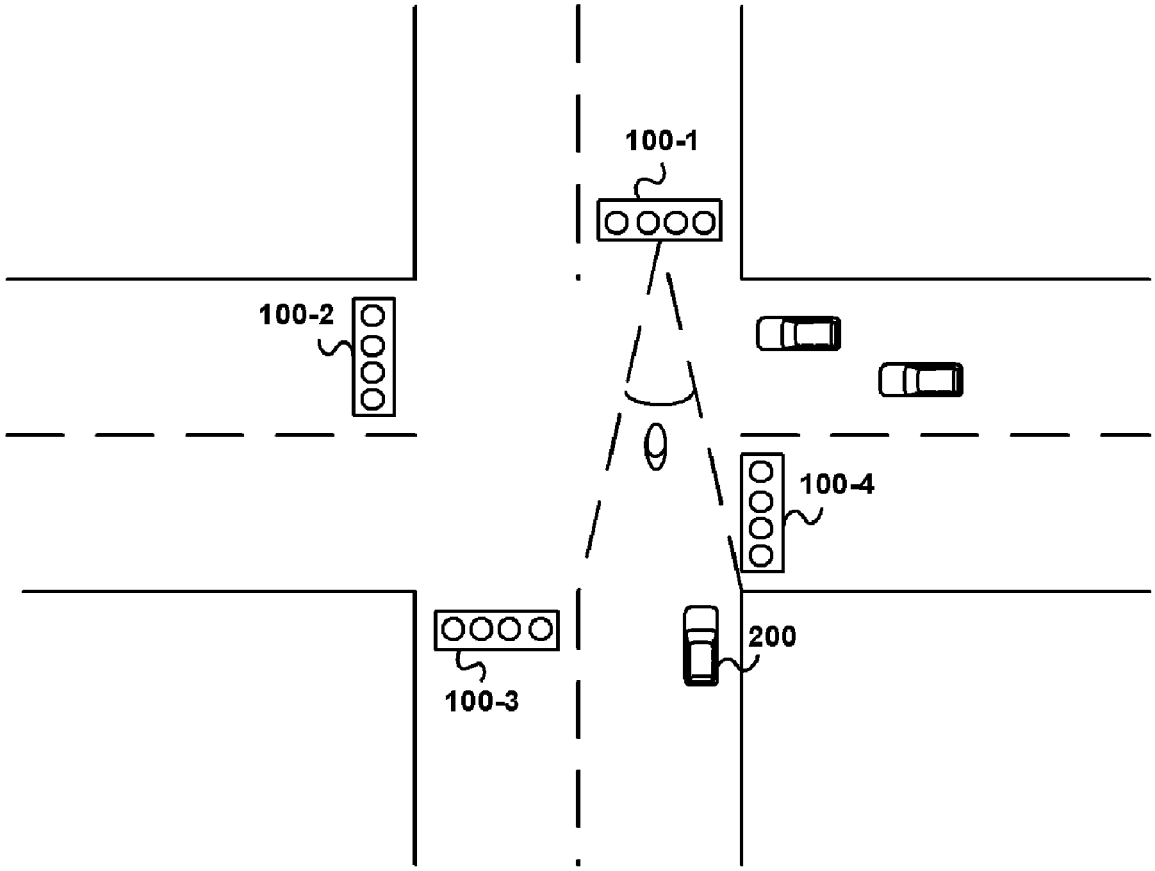
FIG. 1 illustrates a concept of preventing traffic signal violation using infrared communication according to the present invention.

Reference will now be made in detail to the preferred embodiments of the present invention, examples of which are illustrated in the accompanying drawings. Wherever possible, the same reference numerals will be used throughout the drawings to refer to the same or like parts.

The present invention provides a system and method for, when a traffic light changes, in the traffic light, generating a traffic signal information, loading the traffic signal information on an infrared frequency, and transmitting the traffic signal information to a vehicle, and in the vehicle, receiving the infrared frequency, demodulating and analyzing the traffic signal information, activating a braking system of the vehicle to stop the vehicle when the traffic signal information is stop signal information, and removing the vehicle stop and allowing a driver to run the vehicle when the traffic signal information is running signal information. Hereinafter, a description will be made with reference to the drawings.

FIG. 1 illustrates a concept of preventing traffic signal violation using infrared communication according to the present invention, and illustrates a four-way crossroad. In FIG. 1, a reference numeral 100 denotes a traffic light installed at a four-way. Depending on position and number, a sub reference numeral 100-[sub reference numeral] is allocated. A vehicle 200 and a traffic light 100-1 are exemplified to illustrate the concept of preventing the traffic signal violation according to the present invention. Further, traffic lights 100-1, 100-2, 100-3, and 100-4 are collectively controlled by a traffic light control system provided at one side of the four-way. However, only a case of controlling one traffic light 100-1 will be described below.

In the present invention, when the traffic light changes or before a predetermined time when the traffic light changes, the traffic light 100-1 generates the traffic signal information on the traffic light to be changed, and loads and transmits the generated traffic signal information on the infrared frequency. The infrared frequency has a great straightness and therefore, as shown in FIG. 1, should be designed to cover all lanes facing.

If so, a traffic signal violation prevention device of the vehicle receives the infrared frequency, and detects the traffic signal information from the infrared frequency. If the detected traffic signal information is stop signal information, that is, red signal information, the vehicle activates the braking system to stop the vehicle. The above vehicle stop is not performed by the driver and therefore, a traffic accident can occur in case where a vehicle speed is more than a predetermined speed and the vehicle is followed by other vehicles. Accordingly, before the braking system is activated, the vehicle speed and/or a distance from a rear object are/is measured and, when the vehicle speed is less than a predetermined speed and/or the distance from the rear object is more than a predetermined distance, the braking system is activated.

Figure 2:
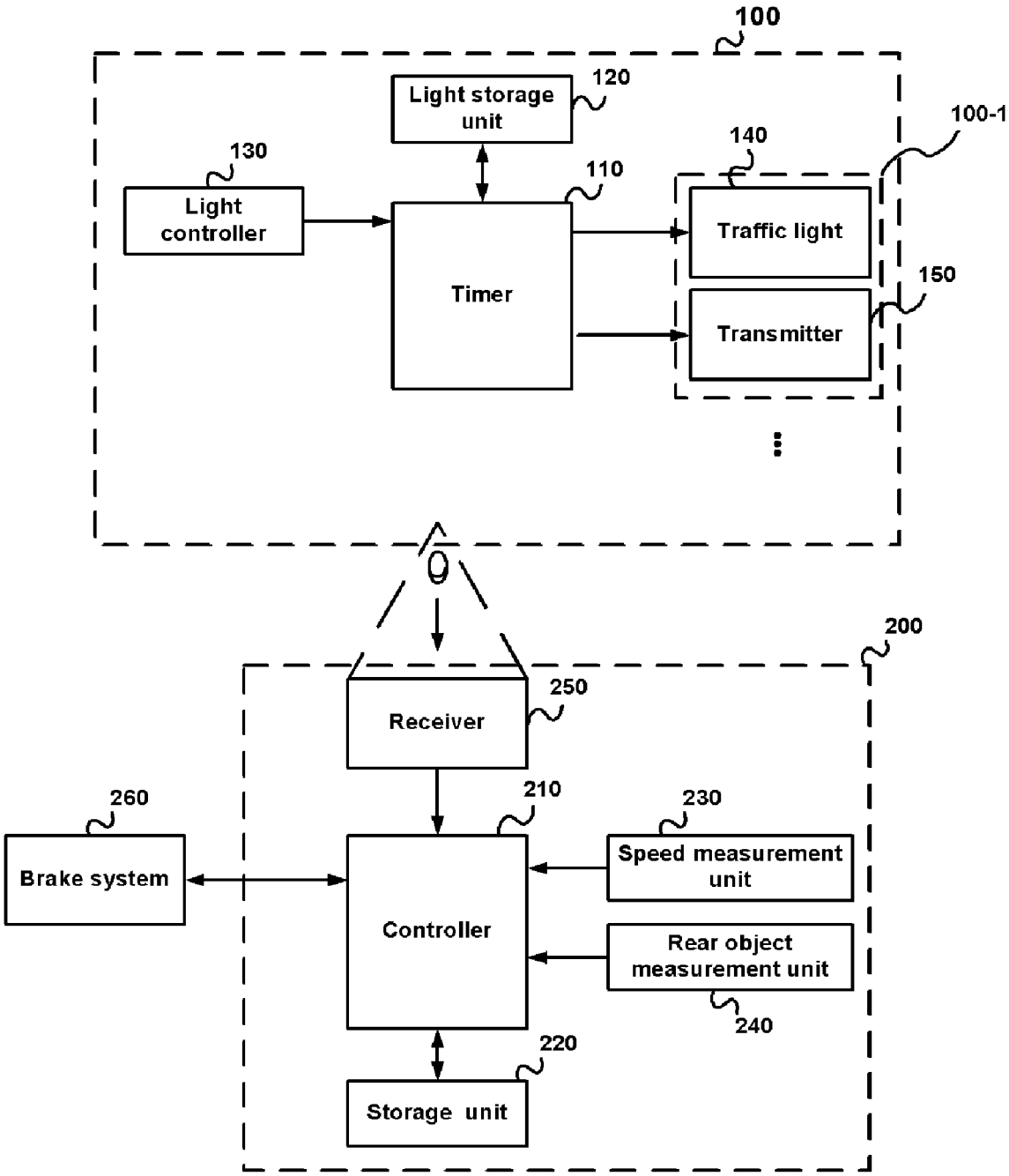
FIG. 2 illustrates a construction of a system for preventing traffic signal violation using infrared communication according to the present invention.

FIG. 2 illustrates a construction of a system for preventing the traffic signal violation using the infrared communication according to the present invention.

A reference numeral 100 denotes the traffic light control system, and a reference numeral 200 denotes the traffic signal violation prevention device.

The traffic light control system 200 includes a plurality of traffic lights 140, a light controller 110, a light storage unit 120, a timer 130, and a transmitter 150.

Each of the traffic lights 140 is comprised of a red light, a green light, and/or a left turn light, and receives each lighting signal and turns on/off.

The timer 130 counts time, and provides counted time information to the light controller 110.

The light storage unit 120 includes a region for storing a control program that sequentially interlocks and controls the plurality of traffic lights 140 and transmitting the traffic signal information, and a region for temporarily storing data generated in execution of the control program.

The transmitter 150 receives the traffic signal information from the light controller 110, and loads and transmits the traffic signal information on the infrared frequency. The infrared frequency has the great straightness and therefore, should be set to allow reception of the vehicles positioned within an angle of θ of FIG. 1. Further, the transmitter 150 should be installed at each of the traffic lights 140.

The light controller 110 controls a general operation of the traffic light controlling system 200 according to the control program. In particular, in the present invention, when the traffic light 140 change a traffic signal, the light controller 110 generates the information on the changed traffic signal of each of the traffic lights 140, and outputs the generated information to the transmitter 110 corresponding to each of the traffic lights 140.

The traffic signal violation prevention device 200 includes a controller 210, a storage unit 220, a speed measurement unit 230, and a rear object measurement unit 240.

The controller 210 controls a general operation for preventing the traffic signal violation according to the present invention. The storage unit 220 is comprised of a region for storing a control program for preventing the traffic signal violation, and a region for temporarily storing data generated in execution of the control program.

The speed measurement unit 230 measures a current running speed of the vehicle, and provides the measured speed data to the controller 210.

The rear object measurement unit 240 detects the rear object positioned in rear of the vehicle, measures the distance to the rear object, and provides the measured distance data to the controller 210.

The receiver 250 receives the infrared frequency including the traffic signal information from the transmitter 110 of the traffic light controlling system 100, that is, from the transmitter 110 corresponding to the traffic light 140 positioned in front of the vehicle as shown in FIG. 1, demodulates the traffic signal information from the infrared frequency, and outputs the demodulated traffic signal information to the controller 210. The controller 210 analyzes the traffic signal information, and generates a stop signal when the traffic signal information is the stop signal information, and generates a stop release signal when the traffic signal information is the running signal information. The stop signal information is generated when the traffic light changes into the red light or a yellow light, and the running signal information is generated when the traffic light changes into the green light and/or the left turn light.

The braking system 260 generally is a system for holding a vehicle wheel to decelerate or stop the vehicle by driver's stepping on a brake pedal. The inventive braking system 260 is an automatic braking system that is enabled not only by driver's stepping on the brake pedal but also by the stop signal and the stop release signal outputted from the controller 210.

Figure 3:
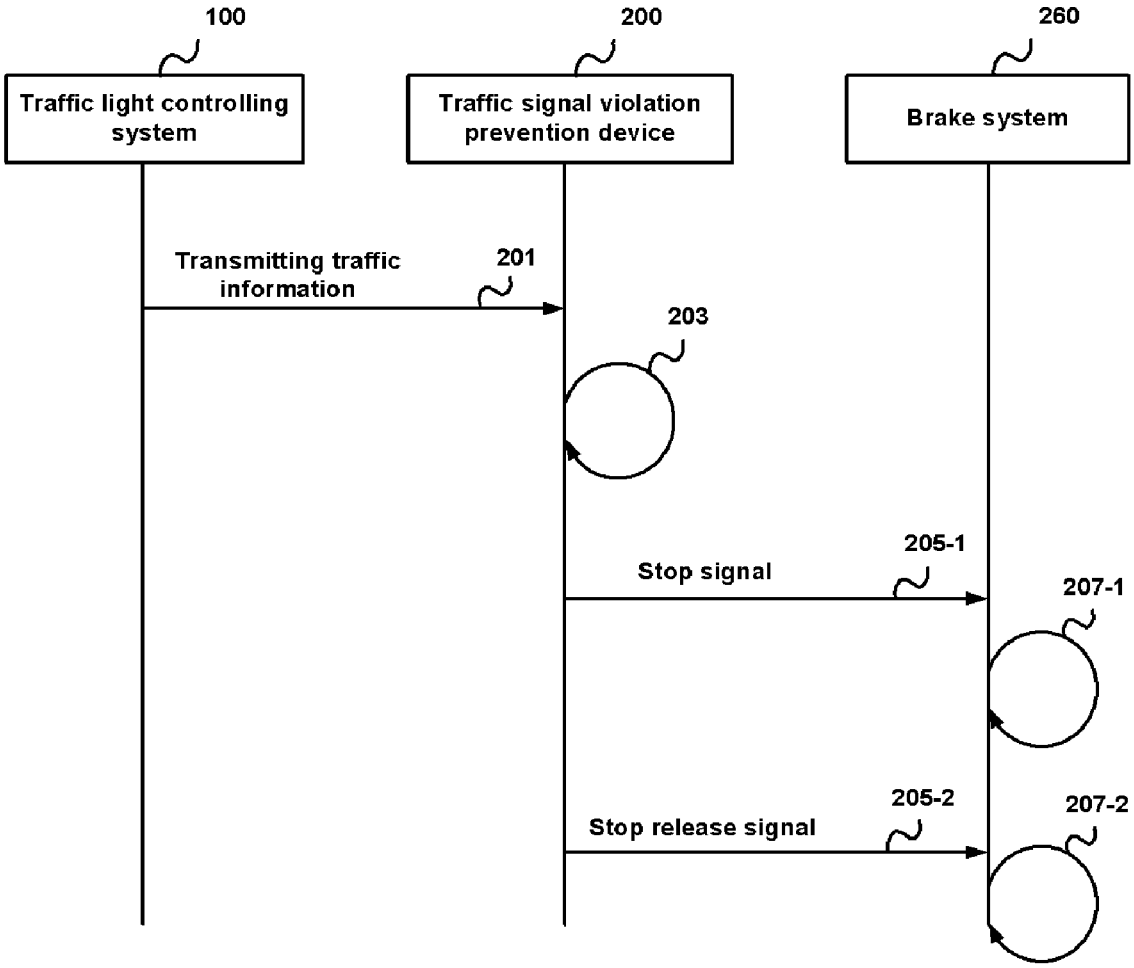
FIG. 3 is a diagram illustrating a method for preventing traffic signal violation using infrared communication according to an embodiment of the present invention.

FIG. 3 is a diagram illustrating a method for preventing the traffic signal violation using the infrared communication according to an embodiment of the present invention.

First, when the traffic light changes, in Step 201, the traffic light control system 100 loads the traffic signal information on the infrared frequency, and transmits the loaded traffic signal information to the traffic signal violation prevention device 200.

Upon receipt of the traffic signal information in the Step 201, in Step 203, the traffic signal violation prevention device 200 determines whether the traffic signal information is the stop signal information or the running signal information, and if it is determined to be the stop signal information, generates and outputs the stop signal to the brake system 260 in Step 205-1.

In Step 207-1, the brake system activates a brake depending on the stop signal received in the Step 205-1.

On the contrary, if it is determined that the traffic signal information is the running signal information, the traffic signal violation prevention device transmits the stop release signal to the brake system 260 in Step 205-2 after the Step 203.

If so, the brake system 260 releases the brake. In case where the stop release signal is inputted in a state where the brake is not activated, the brake system 260 does not perform any operation.

Figure 4:
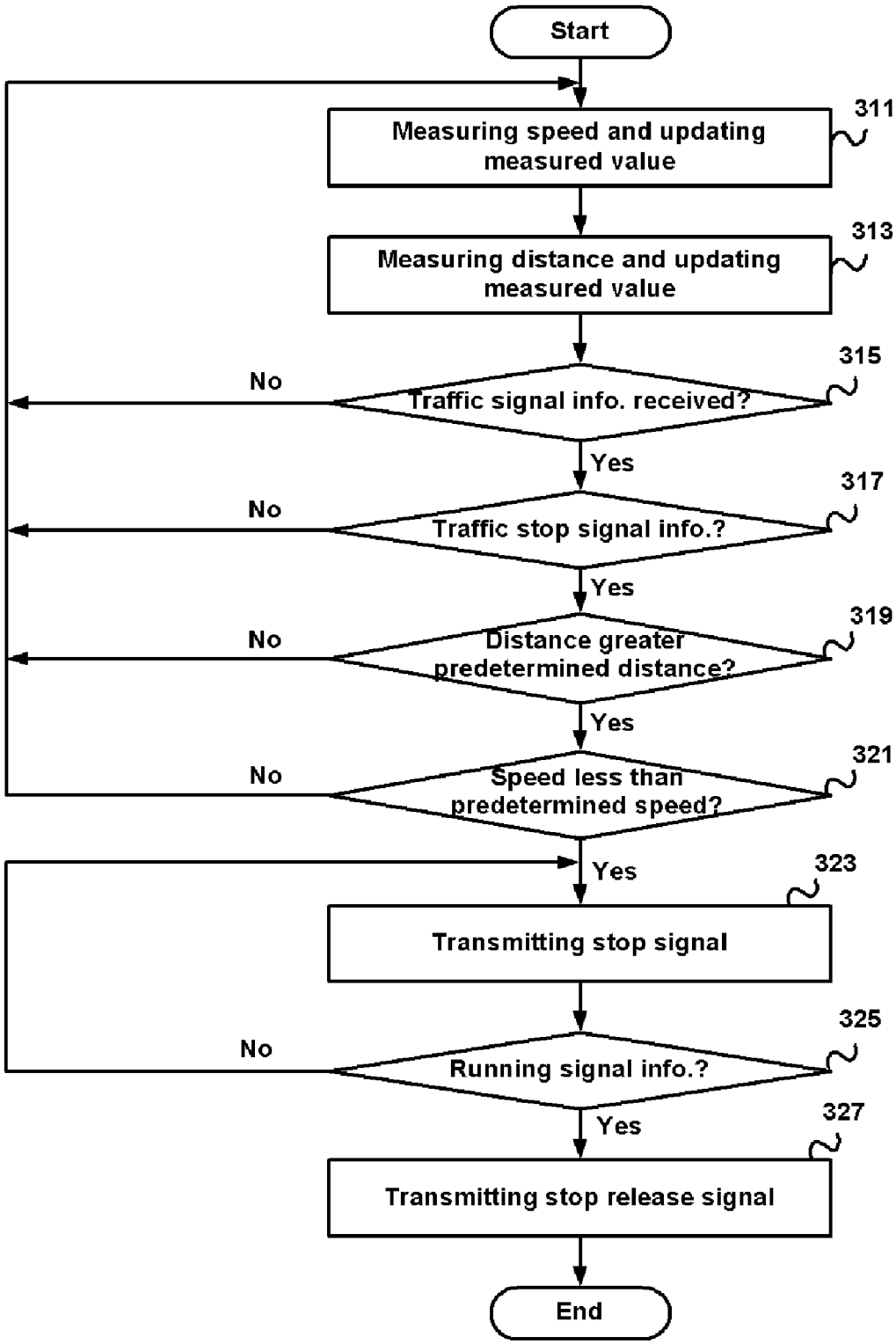
FIG. 4 is a flowchart illustrating a method for preventing traffic signal violation using infrared communication at a side of a traffic signal violation prevention device according to an embodiment of the present invention.

FIG. 4 is a flowchart illustrating a method for preventing the traffic signal violation using the infrared communication at a side of the traffic signal violation prevention device according to an embodiment of the present invention. The method for preventing the traffic signal violation using the infrared communication will be described with reference to the construction of FIG. 2 below.

In the traffic signal violation prevention device 200, the controller 200 measures the running speed of the vehicle through the speed measurement unit 230, and updates the measured speed data in Step 311.

After the Step 311, the controller 210 periodically measures existence or absence of a rear vehicle and the distance to the rear vehicle through the rear object measurement unit 240, and updates the measured distance data.

After the Step 311, the controller 210 determines whether or not to receive the traffic signal information from the receiver 250 in Step 315.

If it is determined to receive the traffic signal information in the Step 315, the controller 210 determines whether or not the received traffic signal information is the stop signal information in Step 317. If it is determined that the traffic signal information is not the stop signal information, the controller 210 performs the Step 311, and if it is determined that the traffic signal information is the stop signal information, the controller 210 performs Step 319. In the Step 319, the controller 210 checks the updated distance data, and determines whether or not the distance data is greater than a reference distance previously set and stored in the storage unit 220. This is because, when the rear vehicle is positioned closely to the vehicle, if the stop signal is outputted to activate the brake, a traffic collision accident against the rear vehicle can occur.

If the rear vehicle is positioned closer than the previously stored reference distance, the controller 210 performs the Step 311, and if being positioned farther, in Step 321, it is determined whether or not the speed data periodically updated and stored is less than reference speed data previously stored in the storage unit 220. Also, this is to prevent a traffic accident occurring when the vehicle suddenly stops with a great running speed. If it is determined that the updated and stored speed data is greater than the reference speed data, the controller 210 performs the Step 311 without any operation, and if it is determined to be less than the reference speed data, the stop signal is outputted to the brake system 260. If so, the brake system activates the brake, and stops the vehicle. While the vehicle stops, the controller 210 determines whether or not to receive the running signal information from the receiver 250 in Step 325. If the traffic signal information is not inputted, the stop signal is continuously outputted to the brake system 260, and if the running signal information is inputted, the stop release signal is transmitted to the brake system 260 and the brake is deactivated in Step 327.

The Steps 319 and 321 can be all judged as in FIG. 4, and only one of both can be applied or not. However, it is desirable to do so in an aspect of prevention of the traffic accident.

As described above, the present invention is advantageous of, since the traffic signal controlling system can provide the traffic signal information and stop and run the vehicle depending on the traffic signal, preventing the driver from violating the traffic signal and reducing the traffic accident caused by the traffic signal violation.

While the present invention has been described with reference to exemplary embodiments thereof, it will be apparent to those skilled in the art that various modifications can be made therein without departing from the spirit and scope of the invention as defined by the appended claims and their equivalents.

What is claimed is:

1. A system for preventing traffic signal violation using infrared communication, the system comprising:

a traffic light controlling system for, when a traffic light changes, transmitting traffic information;

a brake system for decelerating or stopping a vehicle under a predetermined control; and a traffic signal violation prevention device installed at the vehicle, and receiving the traffic information and, if the traffic information is stop signal information, transmitting a stop signal to the brake system, wherein the traffic signal violation prevention device has a distance measurement unit for measuring a distance from another vehicle positioned in rear of the vehicle and, when the measured distance from another vehicle is greater than a predetermined distance, transmits the stop signal to the brake system.

2. The system according to claim 1, wherein the traffic light controlling system comprises:

a timer for counting a time;

a traffic light having a plurality of lights representing whether or not to run the vehicle, and turning on/off under a predetermined control;

a controller for controlling sequential lighting of the traffic lights depending on the counted time and, when the lighted light changes, generating the traffic information; and an infrared transmitter for loading and transmitting the traffic information on an infrared frequency.

3. The system according to claim 1, wherein the traffic signal violation prevention device detects a speed of the vehicle and, when the detected speed is less than a previously set speed, transmits the stop signal to the brake system.

4. The system according to claim 3, wherein the traffic signal violation prevention device has a distance measurement unit for measuring a distance from another vehicle positioned in rear of the vehicle and, when the measured distance from another vehicle is greater than a predetermined distance, transmits the stop signal to the brake system.

5. A method for preventing traffic signal violation using infrared communication, the method comprising the steps of:

when a traffic light changes, transmitting traffic information in a traffic light controlling system;

in a traffic signal violation prevention device, receiving the traffic information and, when the traffic information is stop signal information, generating and transmitting a stop signal; and in a brake system, receiving the stop signal to decelerate or stop a vehicle, wherein the traffic signal violation prevention device has a distance measurement unit for measuring a distance from another vehicle positioned in rear of the vehicle and, when the measured distance from another vehicle is greater than a predetermined distance, transmits the stop signal to the brake system.

6. The method according to claim 5, wherein the traffic signal violation prevention device detects a speed of the vehicle and, when the detected speed is less than a previously set speed, transmits the stop signal to the brake system.

7. The method according to claim 6, wherein the traffic signal violation prevention device has a distance measurement unit for measuring a distance from another vehicle positioned in rear of the vehicle and, when the measured distance from another vehicle is greater than a predetermined distance, transmits the stop signal to the brake system.

* * * * *